US011631941B2

(12) United States Patent
Liu et al.

(10) Patent No.: US 11,631,941 B2
(45) Date of Patent: Apr. 18, 2023

(54) DISPLAY DEVICE AND WIRELESS SIGNAL RECEIVING TERMINAL

(71) Applicant: BOE Technology Group Co., Ltd., Beijing (CN)

(72) Inventors: Zongmin Liu, Beijing (CN); Feng Qu, Beijing (CN); Jia Fang, Beijing (CN); Jijing Huang, Beijing (CN); Mengjun Hou, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 94 days.

(21) Appl. No.: 17/409,145

(22) Filed: Aug. 23, 2021

(65) Prior Publication Data

US 2022/0102870 A1 Mar. 31, 2022

(30) Foreign Application Priority Data

Sep. 28, 2020 (CN) ..... 202011043968.4

(51) Int. Cl.

| | |
|---|---|
| ***H01Q 1/24*** | (2006.01) |
| ***H01Q 21/00*** | (2006.01) |
| ***H01Q 21/06*** | (2006.01) |
| *G09G 3/20* | (2006.01) |

(52) U.S. Cl.
CPC ..... *H01Q 21/0006* (2013.01); *H01Q 1/24* (2013.01); *H01Q 21/065* (2013.01); *G09G 3/20* (2013.01); *G09G 2370/16* (2013.01)

(58) Field of Classification Search
CPC .... H01Q 21/0006; H01Q 1/24; H01Q 21/065; G09G 3/20; G09G 2370/16
See application file for complete search history.

(56) References Cited

U.S. PATENT DOCUMENTS

2022/0021127 A1* 1/2022 Kim ..... G06F 3/011

* cited by examiner

*Primary Examiner* — Dieu Hien T Duong
(74) *Attorney, Agent, or Firm* — Nath, Goldberg & Meyer; Joshua B. Goldberg

(57) ABSTRACT

A display device is provided. The display device includes a display module and an antenna module. The antenna module includes at least one antenna body for receiving a wireless signal; a signal transmission line coupled to the at least one antenna body; an antenna carrier plate having a working region and a bending region, the antenna carrier plate in the bending region is bent from a display surface to a non-display surface, so that the signal transmission line extends from the display surface to the non-display surface; an adapter circuit board on the non-display surface; and an adapter coupling the signal transmission line to the adapter circuit board to enable the adapter circuit board to be signal coupled to the at least one antenna body.

16 Claims, 2 Drawing Sheets

DISPLAY DEVICE AND WIRELESS SIGNAL RECEIVING TERMINAL

TECHNICAL FIELD

The present disclosure relates to the field of communication technologies, and in particular, to a display device and a wireless signal receiving terminal.

BACKGROUND

With the continuous development of display devices, a mobile terminal with full-screen has drawn more and more attention. However, since the mobile terminal with the full-screen has a smaller bezel, a space in which the antenna structure (e.g. 5G millimeter wave antenna) is formed is smaller, and at the same time, the conductivity of the metal bezel and the metal rear cover of the mobile terminal also limits the arrangement of the antenna structure.

Therefore, a solution capable of arranging the antenna structure in the mobile terminal with the full-screen is highly required.

SUMMARY

As an aspect, a display device is provided. The display device includes: a display module including a display surface and a non-display surface opposite to each other; and an antenna module, including: at least one antenna body for receiving a wireless signal; a signal transmission line coupled to the at least one antenna body and configured to transmit a signal from the at least one antenna body; an antenna carrier plate having a working region and a bending region coupled to the working region, wherein the at least one antenna body and at least a portion of the signal transmission line are in the working region, at least a portion of the signal transmission line is in the bending region, the working region is on the display surface of the display module away from the non-display surface, and the antenna carrier plate in the bending region is bent from the display surface to the non-display surface, such that the signal transmission line extends from the display surface to the non-display surface; an adapter circuit board on the non-display surface; and an adapter on the non-display surface and coupling the signal transmission line to the adapter circuit board so as to enable the adapter circuit board to be in signal connection to the at least one antenna body, wherein the adapter is in contact with and overlaps the signal transmission line.

In an embodiment, the signal transmission line is in surface contact with a connection terminal of the adaptor.

In an embodiment, one terminal of the signal transmission line is provided with a gold finger, the connection terminal of the adaptor comprises a connection surface and a connection cover plate, the gold finger is in surface contact with the connection surface, and the connection cover plate is configured to fix the gold finger of the signal transmission line between the connection surface and the connection cover plate.

In an embodiment, an edge of the connection surface is provided with a support wall, and the connection cover plate is in slip connection with the support wall.

In an embodiment, the connection terminal of the adapter further includes a press-fit block, and the press-fit block is a plurality of protruding ridges on a surface of the connection cover plate proximal to the connection surface, between the gold finger and the connection cover plate, and configured to closely contact the gold finger with the connection surface.

In an embodiment, the press-fit block has a thickness of about 0.2 mm.

In an embodiment, the antenna carrier plate has a thickness of about 0.1 mm.

In an embodiment, the signal transmission line is in point connection to the connection terminal of the adaptor.

In an embodiment, the signal transmission line is on a same side of the antenna carrier plate as the at least one antenna body, and the display device further includes a support plate, wherein the support plate is at an edge, which is farthest away from the at least one antenna body in the bending region, of the antenna carrier plate, is on a side of the antenna carrier plate away from the signal transmission line, and is configured to support the antenna carrier plate in the bending region.

In an embodiment, a material of the support plate includes polyimide.

In an embodiment, the adapter is coupled to the adapter circuit board through a welding process.

In an embodiment, each of the at least one antenna body and the at least a portion of signal transmission line in the working region is made of a mesh metal layer, and the at least a portion of the signal transmission line in the bending region is a solid metal line.

In an embodiment, the display device further includes a radio frequency integrated circuit on the non-display surface and signal coupled to the adapter circuit board and a motherboard of the display module respectively.

In an embodiment, the at least one antenna body includes a plurality of antenna bodies arranged in an array of rows and columns in the working region and configured to receive a radio frequency signal.

As another aspect, a wireless signal receiving terminal including the display device described above and a driving circuit for driving the display device.

As yet another aspect, a display device is provided. The display device includes: a display module including a display surface and a non-display surface opposite to each other; and an antenna module, including: at least one antenna body for receiving a wireless signal; a signal transmission line coupled to the at least one antenna body and configured to transmit a signal from the at least one antenna body; an antenna carrier plate having a working region and a bending region coupled to the working region, wherein the at least one antenna body and at least a portion of the signal transmission line are in the working region, at least a portion of the signal transmission line is in the bending region, the working region is on the display surface of the display module away from the non-display surface, and the antenna carrier plate in the bending region is bent from the display surface to the non-display surface, such that the signal transmission line extends from the display surface to the non-display surface; an adapter circuit board on the non-display surface; and an adapter on the non-display surface and coupling the signal transmission line to the adapter circuit board so as to enable the adapter circuit board to be in signal connection to the at least one antenna body, wherein the adapter is in contact with and overlaps the signal transmission line. One terminal of the signal transmission line is provided with a gold finger, a connection terminal of the adaptor includes a connection surface and a connection cover plate, the gold finger is in surface contact with the connection surface, the connection cover plate is configured to fix the gold finger of the signal transmission line between the connection surface and the connection cover plate. An edge of the connection surface is provided with a support wall, and the connection cover plate is in slip connection with the support wall. The connection terminal of the adapter further includes a press-fit block, and the press-fit block is a plurality of protruding ridges on a surface of the connection cover plate proximal to the connection surface, between the gold finger and the connection cover plate, and configured to closely contact the gold finger with the connection surface.

BRIEF DESCRIPTION OF THE DRAWINGS

The accompanying drawings, which facilitate a further understanding of the present disclosure and constitute a part of the specification, are used in conjunction with the following specific embodiments to explain the present disclosure, but are not intended to limit the present disclosure. In the drawings.

DETAILED DESCRIPTION

In order to enable those skilled in the art to better understand the technical scheme of the disclosure, the disclosure will be further described in detail below in combination with the accompanying drawings and specific embodiments.

Figure 1:
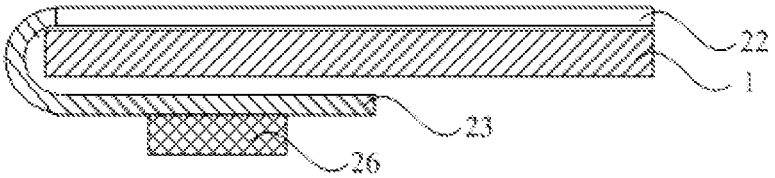
FIG. 1 is a schematic diagram showing a structure of a related display device.
Figure 2:
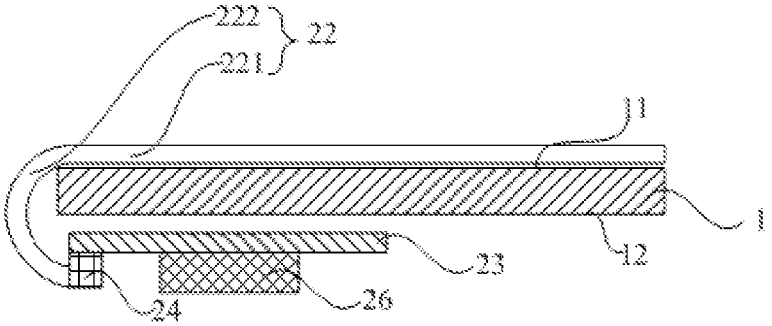
FIG. 2 is a schematic diagram showing a structure of a display device according to an embodiment of the present disclosure.
Figure 3:
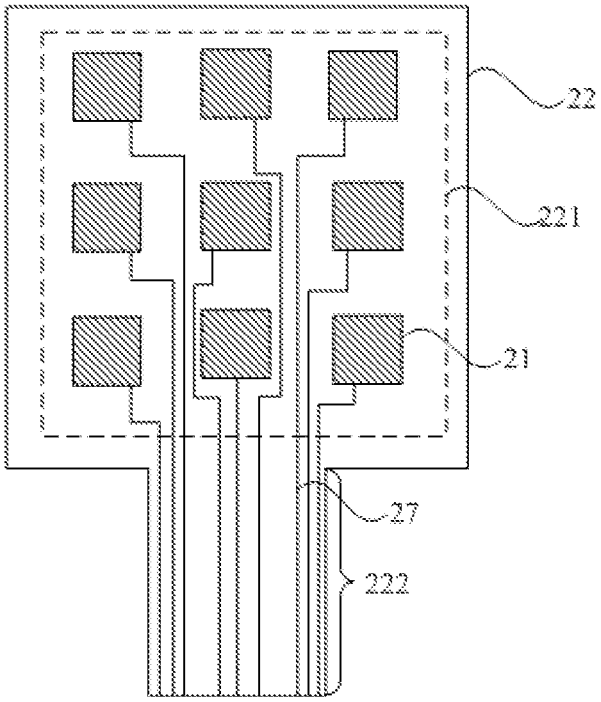
FIG. 3 is a schematic top view showing a structure of an unbent antenna carrier plate of a display device according to an embodiment of the present disclosure.

FIG. 1 is a schematic diagram showing a structure of a related display device. As shown in FIG. 1, an antenna carrier plate 22 carrying an antenna body 21 on a display surface 11 of a display module 1 is directly coupled to the adapter circuit board 23. Specifically, the antenna carrier plate 22 is bonded to the adapter circuit board 23 through a conductive adhesive (such as an ACF anisotropic conductive adhesive or an ACA anisotropic conductive adhesive). The adapter circuit board 23 is bonded to the antenna carrier plate 22 through the conductive adhesive at a high temperature and a high pressure. The working temperature of the antenna carrier plate 22 cannot be too high, such as not higher than 160° C., otherwise the binding process of the conductive adhesive has a bad influence on the antenna body 21 and the antenna carrier plate 22, thereby affecting the reception and transmission of signals.

As shown in FIGS. 2 to 6, the present embodiment provides a display device including: a display module 1 and an antenna module. The display module 1 includes a display surface 11 and non-display surface 12 opposite to each other. The antenna module includes: an antenna body 21, an antenna carrier plate 22, an adapter circuit board 23 and an adapter 24.

The antenna body 21 receives a wireless signal.

The signal transmission line 27 is coupled to the antenna body 21 for transmitting a signal from the antenna body 21.

The antenna carrier plate 22 (such as, a cyclic olefin polymer film (COP)) has a working region 221 and a bending region 222 coupled to the working region 221. The working region 221 is provided with the antenna body 21 and at least a portion of the signal transmission line 27, and an orthographic projection of the working region 221 on the display surface 11 of the display module overlaps the display surface 11. The bending region 222 is provided with at least a portion of the signal transmission line 27. The working region 221 is on the display surface 11 of the display module 1, and the antenna carrier plate in the bending region 222 is bent from the display surface 11 to the non-display surface 12, such that the signal transmission line 27 extends from the display surface 11 to the non-display surface 12.

The adapter circuit board 23 is on the non-display surface 12.

The adapter 24 is on the non-display surface 12 and couples the signal transmission line 27 to the adapter circuit board 23, so that the adapter circuit board 23 is in signal connection to the antenna body 21, wherein the adapter 24 is in lap joint with or contact with and overlaps the signal transmission line 27.

The display module 1 at least includes an insulation structure, such as an encapsulation layer and a plastic frame, therefore the display module 1 is non-conductive as a whole. In the display device of the present embodiment, the antenna module is disposed on the display module 1 which is non-conductive as a whole, so that not only the performance of the antenna module but also the display performance of the display module 1 can be ensured. Other structures such as the antenna carrier plate 22, the adapter circuit board 23, the adapter 24 of the antenna module may be mounted on the display module 1 by using mounting members, and both of the antenna body 21 and the signal transmission line 27 are insulated from the display module 1, so as to ensure the performances of the antenna module and the display module 1.

The antenna body 21 receives a wireless signal, such as a signal from a base station. The antenna body 21 may be constituted by a plurality of antennas, for example, a plurality of millimeter wave antennas. The signal transmission line 27 may include a plurality of metal traces. The antenna carrier plate 22 carries the antenna body 21 and the signal transmission line 27, so that the plurality of antennas and the plurality of metal wires can be arranged relatively fixedly, and the antenna body 21 and the signal transmission line 27 can be disposed on the display module 1 more conveniently. The antenna carrier plate 22 has a bending region 222 capable of being bended. When the antenna carrier plate in the bending region 222 is bent, the signal transmission line 27 may extend from the display surface 11 to the non-display surface 12, and thus the signal transmission line 27 may be coupled to the adapter 24 on the non-display surface 12. The antenna carrier plate 22 may be made of a highly transparent flexible material and have a thickness of about 0.1 mm.

Specifically, the signal transmission process of the antenna module includes the following steps. Firstly, the antenna body 21 receives a wireless signal and transmits a signal formed by the wireless signal to the adaptor 24 via the signal transmission line 27; and then, the adaptor 24 transmits the signal to the adapter circuit board 23.

In the display device of the embodiment, the bending region 222 is added on the antenna carrier plate 22, and the signal transmission line 27 coupled to the antenna body 21 is disposed on the bending region 222. After the antenna carrier plate in the bending region 222 is bent, the signal transmission line 27 is coupled to the adapter circuit board 23 via the adaptor 24, and the adaptor 24 is coupled to (i.e., is in an lap joint with or in contact with and overlaps) the signal transmission line 27, so as to prevent the antenna carrier plate 22 from directly contacting the conductive adhesive, and avoid the influence of high temperature and high pressure on the antenna body 21 and the antenna carrier plate 22 during the bonding process of the conductive adhesive, and ensure the performance of the antenna module.

In addition, after the antenna carrier plate in the bending region 222 is bent, the adaptor 24 and the adaptor circuit board 23 are on the non-display surface 12 (i.e. the back surface of the display surface) of the display module 1, therefore a full-screen display device can be easily manufactured.

Specifically, the first implementation is that the signal transmission line 27 is coupled to the connection terminal of the adapter 24 in a point contact manner.

In other words, the signal transmission line 27 is in point contact crimping with the connection terminal of the adapter 24.

Figure 4:
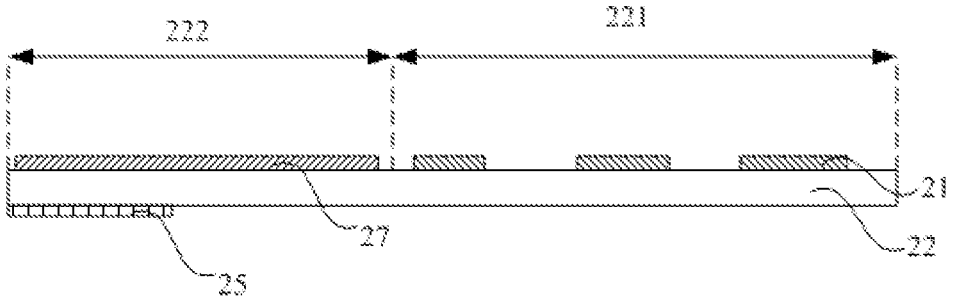
FIG. 4 is a schematic side view showing a structure of an unbent antenna carrier plate of a display device according to an embodiment of the present disclosure.

Further, as shown in FIG. 4 (in FIG. 4 the antenna carrier plate 22 is not bent), the signal transmission line 27 is on a surface of antenna carrier plate 22 away from display module 1. The display device further includes a support plate 25 (i.e., a reinforcing plate) in the bending region 222 and on a surface of the antenna carrier plate 22 proximal to the display module 1 for supporting the bending region 222. In an embodiment, the support plate is located at an edge, which is farthest away from the antenna body in the bending region, of the antenna carrier plate, and is located on a side of the antenna carrier plate away from the signal transmission line.

The signal transmission line 27 and the support plate 25 are located on two sides of the antenna carrier plate 22 respectively, so that the signal transmission line 27 and the support plate 25 do not affect each other. Specifically, the support plate 25 may be made of a non-conductive material (e.g., a PI polyimide film) or other suitable materials.

In order to ensure the strength of the connection terminal of the signal transmission line 27 of the antenna carrier plate 22, a support plate 25 is disposed on a surface of the bending region 222 proximal to the display module 1, and the support plate 25 can stabilize the shape of the connection terminal of the signal transmission line 27 (i.e., stabilize the shape of the metal traces), so as to ensure the stability of the point contact connection between the signal transmission line 27 and the connection terminal of the adaptor 24.

If the support plate 25 is not provided in the embodiment, a metal layer having the same material as the signal transmission line 27 may be provided on a surface of the bending region 222 of the antenna carrier plate 22 proximal to the display module 1. The connection terminal of the adaptor 24 has a shape of a rod or a needle, and one terminal of the adaptor 24 is in contact with the connection terminal of the signal transmission line 27.

Specifically, the second implementation is that the signal transmission line 27 is coupled to the connection terminal of the adapter 24 in a surface contact manner.

It should be noted that, if the signal transmission line 27 has a coplanar waveguide (CPW) structure, a line width and a line pitch of the signal transmission line 27 of the CPW are designed according to the actual structures of the display module 1 and the antenna carrier plate 22, so as to ensure that the impedance of the signal transmission line 27 meets a certain requirement, for example, the impedance is equal to 50Ω. However, if the signal transmission line 27 is coupled to the connection terminal of the adapter 24 in a point contact manner, which results in a mismatch impedance and a loss of the signal; and the signal transmission line 27 has a margin for machining precision, and the branch introduced in the signal transmission line 27 may also result in a large signal loss.

Therefore, in view of the above problems, the embodiment provides a second implementation, namely, the connection terminal of the signal transmission line 27 is coupled to the adaptor 24 in a surface contact manner, so as to ensure that the impedance of the signal transmission line 27 of the coplanar waveguide meets a certain requirement.

Figure 5A:
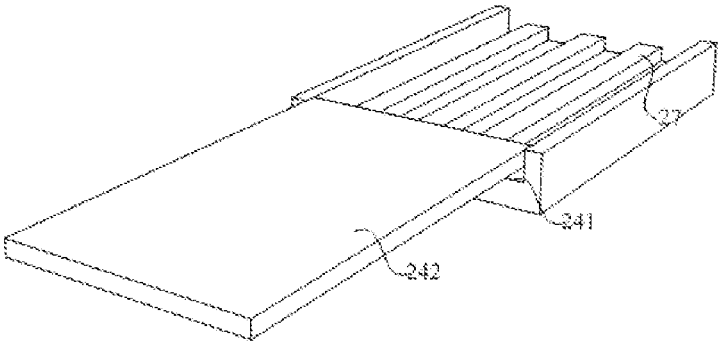
FIG. 5*a* is a schematic diagram showing a connection between an adapter and a signal transmission line of a display device according to an embodiment of the present disclosure.
Figure 5B:
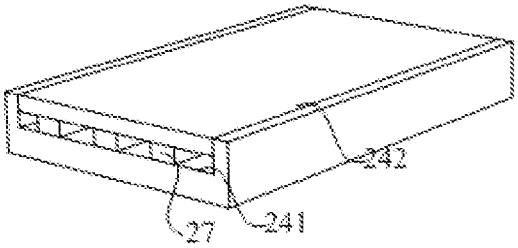
FIG. 5*b* is a schematic diagram showing a connection between an adapter and a signal transmission line of a display device according to an embodiment of the present disclosure.

Further, as shown in FIGS. 5*a* and 5*b*, one terminal of the signal transmission line 27 has a gold finger; the connection terminal of the adapter 24 includes: a connection surface 241 and a connection cover plate 242; the gold finger is coupled to the connection surface 241 in a surface contact manner; and the connection cover plate 242 is configured to fix the gold finger between the connection surface 241 and the connection cover plate 242.

As shown in FIGS. 5*a* and 5*b*, the connection terminal of the signal transmission line 27 are gold fingers, i.e., a plurality of strips. The connection terminal of the adapter 24 has the connection surface 241 electrically coupled to the gold fingers and is coupled in surface contact with the gold fingers having a strip shape. The connection cover plate 242 of the adapter 24 presses the gold fingers on the connection surface 241 to make the connection between the gold fingers and the connection surface 241 more stable. Support walls are disposed at an edge of the connection surface 241, and the connection cover plate 242 is slidably coupled to (or slip connection with) the support walls, so that the connection cover plate 242 is similar to a pulling plate with respect to the connection surface 241.

Meanwhile, the structure of the adapter 24 facilitates connection and disconnection of the gold fingers of the signal transmission line 27 to and from the adapter 24, so that the manufacturing process of the display device is simplified.

Figure 6:
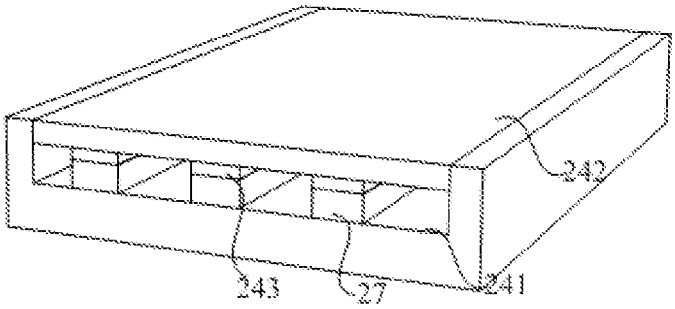
FIG. 6 is a schematic diagram showing a connection between an adapter and a signal transmission line of a display device according to an embodiment of the present disclosure.

Further, as shown in FIG. 6, the connection terminal of the adaptor 24 further includes: press-fit blocks 243 located between the gold fingers and the connection cover plate 242 for closely contacting the gold fingers with the connection surface 241.

In other words, in order to make the gold fingers fully contact with the connection surface 241 (i.e., closely contact), the press-fit blocks 243 are disposed between the gold fingers and the connection cover plate 242, and the shape of the press-fit blocks 243 matches the shape of the gold fingers, so that the connection cover plate 242 can contact the gold fingers to the connection surface 241 more closely through the press-fit blocks 243, thereby ensuring the contact strength and the pressure uniformity of the connection of the signal transmission line 27 and the adaptor 24. The press-fit blocks 243 have a thickness of about 0.2 mm.

The press-fit blocks 243 may be directly fixed to a surface of the connection cover plate 242 proximal to the connection surface 241, that is, the press-fit blocks 243 are a plurality of protruding ridges (or convex strips) on the connection cover plate 242.

In an embodiment, the adapter 24 and the adapter circuit board 23 are coupled together through a welding process.

Specifically, the welding process is a surface mount process, such as fixing by the welding tin.

In an embodiment, each of the antenna body 21 and the at least a portion of the signal transmission line 27 located in the working region 221 has a mesh structure.

In order to adapt to the pixel arrangement or the transparent display structure of the display module 1, each of the antenna body 21 and the at least a portion of the signal transmission lines 27 in the working region 221 is a mesh single-layer metal radiating element. In an embodiment, the at least one antenna body and the at least a portion of the signal transmission line located in the working region are made of a mesh metal layer.

The signal transmission line 27 located in the bending region 222 may be a solid metal line to ensure the transmission performance of the signal transmission line 27.

In an embodiment, the display device of the present embodiment further includes: a radio frequency integrated circuit (i.e., a radio frequency IC) 26 located at the non-display surface 12 and in signal connection to the adapter circuit board 23 and a motherboard of the display module 1 respectively.

The RF integrated circuit 26 may be located on a side of the adapter circuit board 23 away from the display module 1, and coupled to the adapter circuit board 23. The adapter circuit board 23 and the RF integrated circuit 26 may be provided on a separate motherboard or a separate adapter board, and the separate adapter board may be made of a conventional RF circuit board material.

Specifically, the signal transmission process of the antenna module includes the following steps. Firstly, the antenna body 21 receives a wireless signal and transmits a signal formed by the wireless signal to the adaptor 24 via the signal transmission line 27; next the adapter 24 transmits the signal to the adapter circuit board 23; and then the adapter circuit board 23 transmits the signal to the motherboard of the display module 1 via the RF integrated circuit 26 to identify the wireless signal.

Specifically, the antenna body 21 receives a radio frequency signal. In an embodiment, the antenna body 21 may be a plurality of antenna bodies arranged in an array of rows and columns in the working region.

Specifically, the antenna body 21 in the embodiment is an antenna for receiving signals in 5G millimeter wave band, and the size of each antenna in the antenna body 21 can be up to millimeter level, so that it is possible to deploy the antenna module in a wireless signal receiving terminal (such as a mobile terminal).

It should be noted that the antenna body 21 may also receive other types of wireless signals, which is not limited to the above-mentioned type.

Specifically, the display device may be any product or component having a display function, such as a liquid crystal display panel board, an organic light emitting diode (OLED) display panel board, electronic paper, a mobile phone, a tablet computer, a television, a display, a notebook computer, a digital photo frame, and a navigator.

As shown in FIG. 1 to FIG. 6, an embodiment provides a wireless signal receiving terminal, which includes the display device in any one of the above embodiments and a driving circuit for driving the display device.

In the display device capable of receiving a wireless signal in the embodiment, the bending region 222 is added on the antenna carrier plate 22, and the signal transmission line 27 of the antenna body 21 is disposed on the bending region 222. When the antenna carrier plate in the bending region 222 is bent, the signal transmission line 27 is coupled to the adapter circuit board 23 via the adaptor 24, and the adaptor 24 is coupled to (i.e., contacts and overlaps) the signal transmission line 27, thereby preventing the antenna carrier plate 22 from directly contacting with the conductive adhesive, in turn preventing the influence of high temperature and high pressure during the bonding process of the conductive adhesive on the antenna body 21 and the antenna carrier plate 22, and ensuring the performance of the antenna module.

In addition, after the antenna carrier plate in the bending region 222 is bent, the adaptor 24 and the adaptor circuit board 23 are on the non-display surface 12 (i.e. the back surface of the display surface) of the display module 1, therefore a full-screen display device, i.e. a mobile terminal having a full-screen or the like, can be easily manufactured.

It should be noted that, in the embodiments, relational terms such as first and second, and the like are used solely to distinguish one entity or action from another entity or action without necessarily requiring or implying any actual such relationship or order between such entities or actions. Also, the terms "include," "comprise" or any other variation thereof, are intended to cover a non-exclusive inclusion, such that a process, method, article, or apparatus that comprises a list of elements does not include only those elements but may include other elements not expressly listed or inherent elements for such process, method, article, or apparatus. Without further limitation, an element defined by the phrase "comprising an . . . " does not exclude the presence of other identical elements in the process, method, article, or apparatus comprising the element.

It should be understood that the above implementations are merely exemplary embodiments for the purpose of illustrating the principles of the present disclosure, however, the present disclosure is not limited thereto. It will be apparent to those skilled in the art that various changes and modifications can be made without departing from the spirit and essence of the present disclosure, which are also to be regarded as the scope of the present disclosure.

What is claimed is:

1. A display device, comprising:

a display module comprising a display surface and a non-display surface opposite to each other; and an antenna module, comprising:

at least one antenna body for receiving a wireless signal;

a signal transmission line coupled to the at least one antenna body and configured to transmit a signal from the at least one antenna body;

an antenna carrier plate having a working region and a bending region coupled to the working region, wherein the at least one antenna body and at least a portion of the signal transmission line are in the working region, at least a portion of the signal transmission line is in the bending region, the working region is on the display surface of the display module away from the non-display surface, and the antenna carrier plate in the bending region is bent from the display surface to the non-display surface, such that the signal transmission line extends from the display surface to the non-display surface;

an adapter circuit board on the non-display surface; and an adapter on the non-display surface and coupling the signal transmission line to the adapter circuit board so as to enable the adapter circuit board to be in signal connection to the at least one antenna body, wherein the adapter is in contact with and overlaps the signal transmission line.

2. The display device of claim 1, wherein the signal transmission line is in surface contact with a connection terminal of the adaptor.

3. The display device of claim 2, wherein one terminal of the signal transmission line is provided with a gold finger, the connection terminal of the adaptor comprises a connection surface and a connection cover plate, the gold finger is in surface contact with the connection surface, and the connection cover plate is configured to fix the gold finger of the signal transmission line between the connection surface and the connection cover plate.

4. The display device of claim 3, wherein an edge of the connection surface is provided with a support wall, and the connection cover plate is in slip connection with the support wall.

5. The display device of claim 3, wherein the connection terminal of the adapter further comprises a press-fit block, and the press-fit block is a plurality of protruding ridges on a surface of the connection cover plate proximal to the connection surface, between the gold finger and the connection cover plate, and configured to closely contact the gold finger with the connection surface.

6. The display device of claim 5, wherein the press-fit block has a thickness of about 0.2 mm.

7. The display device of claim 1, wherein the antenna carrier plate has a thickness of about 0.1 mm.

8. The display device of claim 1, wherein the signal transmission line is in point connection to the connection terminal of the adaptor.

9. The display device of claim 8, wherein the signal transmission line is on a same side of the antenna carrier plate as the at least one antenna body, and the display device further comprises a support plate, wherein the support plate is at an edge, which is farthest away from the at least one antenna body in the bending region, of the antenna carrier plate, is on a side of the antenna carrier plate away from the signal transmission line, and is configured to support the antenna carrier plate in the bending region.

10. The display device of claim 9, wherein a material of the support plate comprises polyimide.

11. The display device of claim 1, wherein the adapter is coupled to the adapter circuit board through a welding process.

12. The display device of claim 1, wherein each of the at least one antenna body and the at least a portion of signal transmission line in the working region is made of a mesh metal layer, and the at least a portion of the signal transmission line in the bending region is a solid metal line.

13. The display device of claim 1, further comprising: a radio frequency integrated circuit on the non-display surface and signal coupled to the adapter circuit board and a motherboard of the display module respectively.

14. The display device of claim 1, wherein the at least one antenna body comprises a plurality of antenna bodies arranged in an array of rows and columns in the working region and configured to receive a radio frequency signal.

15. A wireless signal receiving terminal comprising the display device of claim 1 and a driving circuit for driving the display device.

16. A display device, comprising:

a display module comprising a display surface and a non-display surface opposite to each other; and an antenna module, comprising:

at least one antenna body for receiving a wireless signal;

a signal transmission line coupled to the at least one antenna body and configured to transmit a signal from the at least one antenna body;

an antenna carrier plate having a working region and a bending region coupled to the working region, wherein the at least one antenna body and at least a portion of the signal transmission line are in the working region, at least a portion of the signal transmission line is in the bending region, the working region is on the display surface of the display module away from the non-display surface, and the antenna carrier plate in the bending region is bent from the display surface to the non-display surface, such that the signal transmission line extends from the display surface to the non-display surface;

an adapter circuit board on the non-display surface; and an adapter on the non-display surface and coupling the signal transmission line to the adapter circuit board so as to enable the adapter circuit board to be in signal connection to the at least one antenna body, wherein the adapter is in contact with and overlaps the signal transmission line, wherein one terminal of the signal transmission line is provided with a gold finger, a connection terminal of the adaptor comprises a connection surface and a connection cover plate, the gold finger is in surface contact with the connection surface, the connection cover plate is configured to fix the gold finger of the signal transmission line between the connection surface and the connection cover plate, an edge of the connection surface is provided with a support wall, and the connection cover plate is in slip connection with the support wall, the connection terminal of the adapter further comprises a press-fit block, and the press-fit block is a plurality of protruding ridges on a surface of the connection cover plate proximal to the connection surface, is between the gold finger and the connection cover plate, and is configured to closely contact the gold finger with the connection surface.

* * * * *